US008074317B2

(12) United States Patent
Neighley et al.

(10) Patent No.: US 8,074,317 B2
(45) Date of Patent: Dec. 13, 2011

(54) CLEANING TOWEL

(76) Inventors: Kevin Arthur Neighley, Kansas City, MO (US); Christina Renee Scott, Kansas Ticy, MO (US)

( * ) Notice: Subject to any disclaimer, the term of this patent is extended or adjusted under 35 U.S.C. 154(b) by 430 days.

(21) Appl. No.: 12/419,464

(22) Filed: Apr. 7, 2009

(65) Prior Publication Data

US 2009/0255079 A1 Oct. 15, 2009

Related U.S. Application Data

(60) Provisional application No. 61/123,690, filed on Apr. 10, 2008.

(51) Int. Cl.
*A47L 13/16* (2006.01)

(52) U.S. Cl. ..... 15/118; 15/104.93; 15/208; 15/209.1; 428/102; 428/122; 428/192; 442/346

(58) Field of Classification Search ..... 15/104.93, 15/118, 208, 209.1; 401/201, 183; 428/102, 428/121–123, 190, 192, 193, 223; 442/346, 442/366

See application file for complete search history.

(56) References Cited

U.S. PATENT DOCUMENTS

| | | | | | |
|---|---|---|---|---|---|
| 2,233,746 | A * | 3/1941 | Potter | ..... | 15/209.1 |
| 2,654,191 | A * | 10/1953 | Pusch | ..... | 15/118 |
| 3,060,504 | A * | 10/1962 | Thomas et al. | ..... | 264/167 |
| 4,355,066 | A * | 10/1982 | Newman | ..... | 428/198 |
| 4,906,513 | A * | 3/1990 | Kebbell et al. | ..... | 428/198 |
| 5,140,785 | A * | 8/1992 | Eleouet | ..... | 451/523 |
| 5,804,279 | A * | 9/1998 | Pluth | ..... | 428/124 |
| 5,879,094 | A * | 3/1999 | Lersch et al. | ..... | 401/139 |
| 2003/0233717 | A1 * | 12/2003 | Ortega et al. | ..... | 15/118 |

* cited by examiner

*Primary Examiner* — Mark Spisich
(74) *Attorney, Agent, or Firm* — Hovey Williams LLP

(57) ABSTRACT

A towel specifically designed for cleaning vehicles and other surfaces without the use of soap or other cleaning agents is formed of a combination of microfiber material and chamois material and comprises a first relatively thicker portion formed primarily of an underlying layer of material and an outer layer of microfiber material that is folded over and attached to both faces of the underlying layer of material; and a second relatively thinner portion formed primarily of chamois material.

19 Claims, 3 Drawing Sheets

CLEANING TOWEL

RELATED APPLICATION

This nonprovisional patent application claims priority benefit, with regard to all common subject matter, of earlier-filed U.S. provisional patent application titled "MICROFIBER-CHAMOIS," Ser. No. 61/123,690, filed Apr. 10, 2008. The identified earlier-filed application is hereby incorporated by reference in its entirety into the present application.

BACKGROUND

The present invention relates to cleaning towels. More particularly, the invention relates to a cleaning towel specifically designed for cleaning vehicles, floors, countertops, or any other surfaces without the use of soap or other cleaning agents.

Many different cleaning towels, sponges, brushes, etc. have been developed for cleaning all types of surfaces. For example, cleaning towels are frequently used by auto dealers to clean vehicles on their lots to make them more attractive to potential buyers. Although many dealers have on-site car washes, it is often too time-consuming and costly to use them for frequent cleanings, especially for large dealers with many vehicles that must be cleaned several times a week. Therefore, many auto dealers clean, or hire others to clean, their vehicles in-place with portable or truck-mounted power washers or even with long garden hoses.

To reduce the runoff of soaps, detergents, and other cleaning agents into storm sewers (which typically drain directly to rivers, streams, or lakes), many governments prohibit the use of cleaning agents on surface lots and other areas that are not properly drained or filtered. Therefore, auto dealers typically must clean vehicles on their lots with water only. The same is true for auto detailers, individual car owners, and others who wash their vehicles in parking lots, driveways, and other areas that drain to storm sewers. Unfortunately, existing cleaning towels do not effectively clean and dry vehicles with water only.

These same problems also apply to the cleaning of other surfaces such as floors, countertops, appliances, cabinets, etc. Even when the use of soaps and detergents is not prohibited, many people prefer to eliminate or at least minimize the use of them for environmental reasons.

SUMMARY

The present invention provides a distinct advance in the art of cleaning towels by providing a towel specifically designed for cleaning vehicles and other surfaces without the use of soap or other cleaning agents.

The cleaning towel of the present invention is formed of microfiber material and chamois material and may be any size and shape. One embodiment of the towel comprises a first relatively thicker portion and a second thinner portion. The first thicker portion is formed primarily of an underlying layer of material and two outer layers of microfiber material. The second relatively thinner portion is formed primarily of chamois material.

To clean a vehicle or other surface with the towel, the surface may first be sprayed with water or the towel may be dipped in clean water and then wrung to remove excess water. Alternatively, the towel may be used without any water for dusting purposes. A user then places one or both hands on one face of the towel and wipes the towel across the surface with the first portion leading. The towel may also be attached to a mop head or other device used for cleaning.

The first portion of the towel, which includes outer layers of microfiber material, effectively removes dirt, water, and debris from the surface without scratching it. Also, because the first portion is thicker than the second portion, a user can firmly compress it against the surface to remove all dirt and contaminants therefrom. The second, relatively thinner portion of the towel, which is formed primarily of water-absorbing chamois material, removes spots and streaks as it is dragged across the surface. Thus, a single towel constructed in accordance with embodiments of the present invention may be used to simultaneously clean and dry a surface without soap or other cleaning agents and without leaving spots or streaks. After the towel is used to thoroughly clean and dry the surface, it may be washed and used again and again to clean other surfaces.

In one embodiment, the first portion of the towel occupies a relatively small percentage of the total surface area of the towel. This embodiment is particularly useful for cleaning vehicles or other surfaces that primarily just need to have spots and streaks removed. For example, the towel of this embodiment may be used to clean and dry vehicles after a rainstorm or to clean vehicles that have been lightly sprayed with water.

In another embodiment, the first portion of the towel occupies approximately half the total surface area of the towel. This embodiment is particularly useful for cleaning vehicles or other surfaces that are moderately dirty and need to have spots and streaks removed. Because microfiber material glides across metal and other surfaces more easily than chamois material, this embodiment of the towel experiences less friction during use and is therefore easier to control and guide across the surface being cleaned.

In yet another embodiment, the first portion of the towel occupies the majority of the total surface area of the towel. This embodiment is particularly useful for dirty vehicles or other surfaces that need to be thoroughly cleaned. This embodiment is also ideal for attachment to a mop head such as a Swiffer® mop.

A towel constructed in accordance with yet another embodiment of the invention may be used in areas where waxes, soaps and other cleaning agents are not prohibited. In this embodiment, the first portion of the towel includes an underlying layer that is partially folded over itself to form an elongated pocket that runs the entire width of the towel. An elongated bar or perforated tube of wax, soap or other cleaning agent may be inserted into the pocket so that it can seep through the layers to assist with cleaning.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
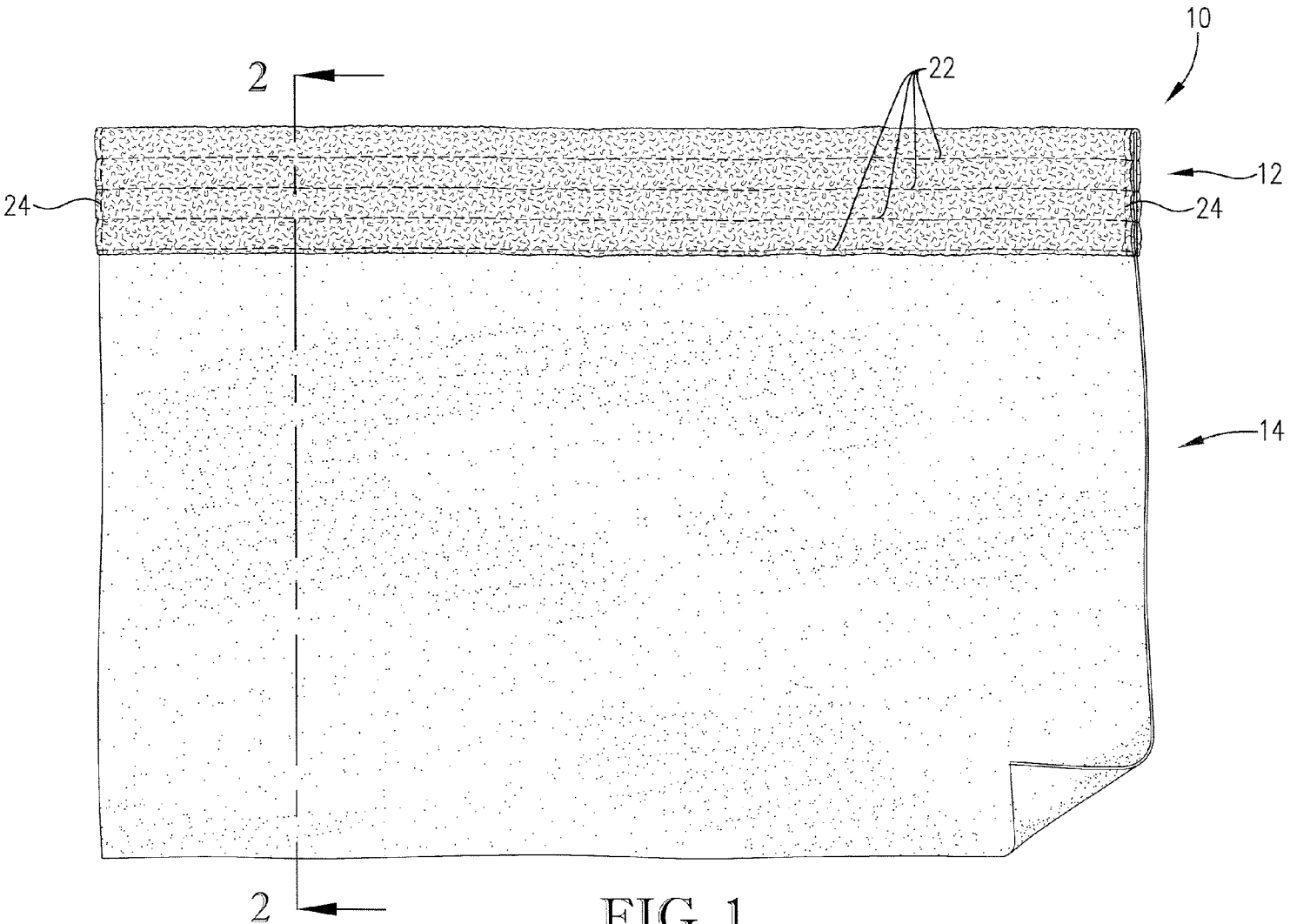
FIG. 1 is a top view of a cleaning towel constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced.

The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

The invention provides various embodiments of cleaning towels specifically designed for cleaning vehicles and other surfaces without the use of soap or other cleaning agents. The towels are primarily formed from microfiber material and chamois material and may be any size and shape. Although the towels are particularly useful for cleaning vehicles, they can also be used to clean floors, countertops, cabinets, appliances, or any other surfaces.

Figure 2:
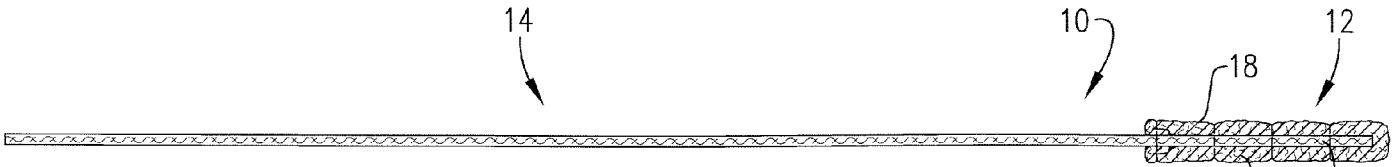
FIG. 2 is a side sectional view of the cleaning towel taken along line 2-2 of FIG. 1.

Turning now to the drawing figures, and particularly FIGS. 1 and 2, a cleaning towel 10 constructed in accordance with a first embodiment of the invention is illustrated. The cleaning towel 10 is formed primarily of microfiber material and chamois material, and comprises a first relatively thicker portion 12 and a second relatively thinner portion 14. As best shown in FIG. 2, the first portion 12 comprises an underlying layer 16 and two outer layers 18, 20. The underlying layer 16 may be formed of a porous, non-abrasive natural leather chamois material or a synthetic chamois material designed to simulate natural leather chamois. The underlying layer 16 may also be formed of microfiber or other material that is more pliable and less expensive than chamois. The outer layers 18, 20 are formed of microfiber material made from polyesters, polyamides, and/or a combination of these or other materials. The microfiber material preferably has a fiber with less than 1 denier per filament.

The underlying layer 16 may be approximately 1/16"-1/8" thick and each outer layer 18, 20 may also be approximately 1/16"-1/8" thick. Thus, the overall thickness of the first layer may be between 3/16"-3/8" thick; however, it may be thicker or thinner without departing from the scope of the invention.

In one embodiment, the first portion 12 is formed by folding a piece of microfiber material over one edge of a larger piece of chamois material and sewing or otherwise attaching the microfiber material to both faces of the underlying chamois material. Thus, the chamois material forms the underlying layer 16 and the folded-over microfiber material forms the outer layers 18, 20. The layers 16, 18, 20 may be secured to one another by several parallel stitch lines 22 and a pair of end stitch lines 24 as best shown in FIG. 1. The layers 16, 18, 20 may also be attached with glue or by other conventional means.

The underlying layer 16 may underlie substantially the whole portion of the outer layers 18, 20 as shown in the drawing figures or may underlie only an edge or small portion of the outer layers 18, 20. This permits the first portion of the towel 12 to be made more pliable by extending the relatively more flexible outer layers 18, 20 beyond the edge of the underlying layer 16.

The second relatively thinner portion 14 of the towel is formed of chamois material and may be an extension of the underlying layer 16 of the first portion 12. In other words, the second portion 14 and underlying layer 16 may be formed from a single piece of chamois material. In one embodiment the second portion is approximately 1/16"-1/8" thick; however, it may be thicker or thinner without departing from the scope of the invention. Because the second portion 14 consists of only one layer of material, it is approximately 1/3 the thickness of the first portion 12.

To clean a vehicle or other surface with the towel, the surface may first be sprayed with water or the towel may be dipped in clean water and then wrung to remove excess water. Alternatively, the towel may be used without any water. A user then places one or both hands on one face of the towel and wipes the towel across the surface with the first portion leading. The towel may also be attached to a mop head or other device for cleaning.

Because the first portion 12 of the towel includes outer layers 18, 20 of microfiber material, it effectively removes dirt, water, and debris from a surface without scratching it. Also, because the first portion is thicker than the second portion, a user can firmly compress it against the surface to remove all dirt and contaminants therefrom. Because the second, relatively thinner portion of the towel is formed primarily of water-absorbing chamois material, it removes spots and streaks as it is dragged across the surface. Thus, a single towel constructed in accordance with embodiments of the present invention may be used to simultaneously clean and dry a surface without soap or other cleaning agents and without leaving spots or streaks. After the towel is used to thoroughly clean and dry the surface, it may be washed and used again and again to clean other surfaces.

As best shown in FIG. 1, the first portion 12 of the towel occupies a relatively small percentage of the total surface area of the towel. In a particular embodiment, the first portion occupies approximately 10-40% of the surface area of the towel. For example, if the towel is 12" wide (measured from right to left in FIG. 1) and 8" long (measured from top to bottom in FIG. 1), each face thereof has an approximate total surface area of 96 square inches. Each face of the first portion may therefore be 19.2-28.8 square inches and each face of the second portion may be 67.2-76.8 square inches. Such an embodiment is particularly useful for cleaning vehicles that primarily just need to have spots and streaks removed. For example, the towel of this embodiment may be used to clean vehicles after a rainstorm.

Figure 3:
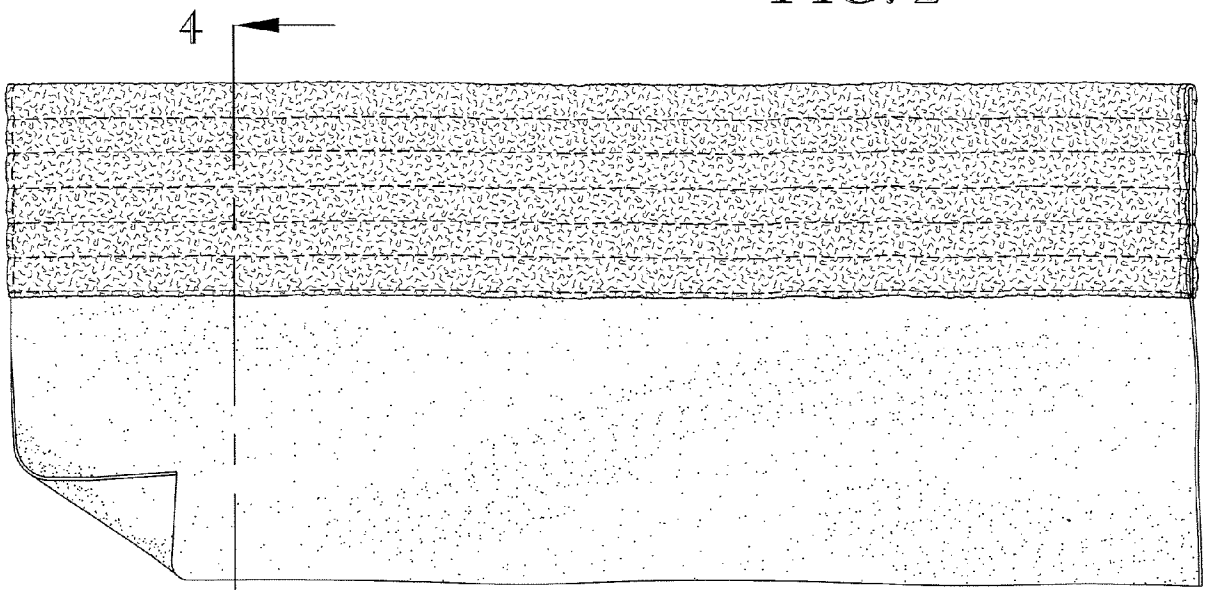
FIG. 3 is a top view of a cleaning towel constructed in accordance with an alternate embodiment of the invention.
Figure 4:
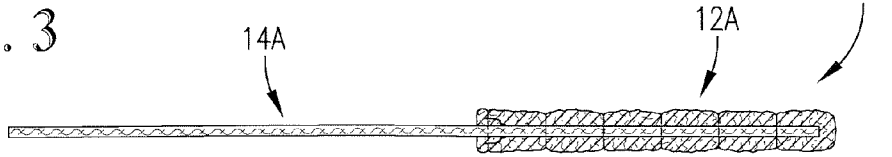
FIG. 4 is a side sectional view of the cleaning towel taken along line 4-4 of FIG. 3.

FIGS. 3 and 4 illustrate a towel 10A constructed in accordance with an alternate embodiment of the invention. The towel 10A is substantially identical to the towel 10 of FIGS. 1 and 2 except that its first portion 12A occupies a relatively larger percentage of the total surface of the towel. Specifically, the first portion 12A may occupy between 40-60% of the total surface area of the towel 10A. The towel 10A is particularly useful for cleaning moderately dirty vehicles that need to be cleaned and have spots and streaks removed.

Figure 5:
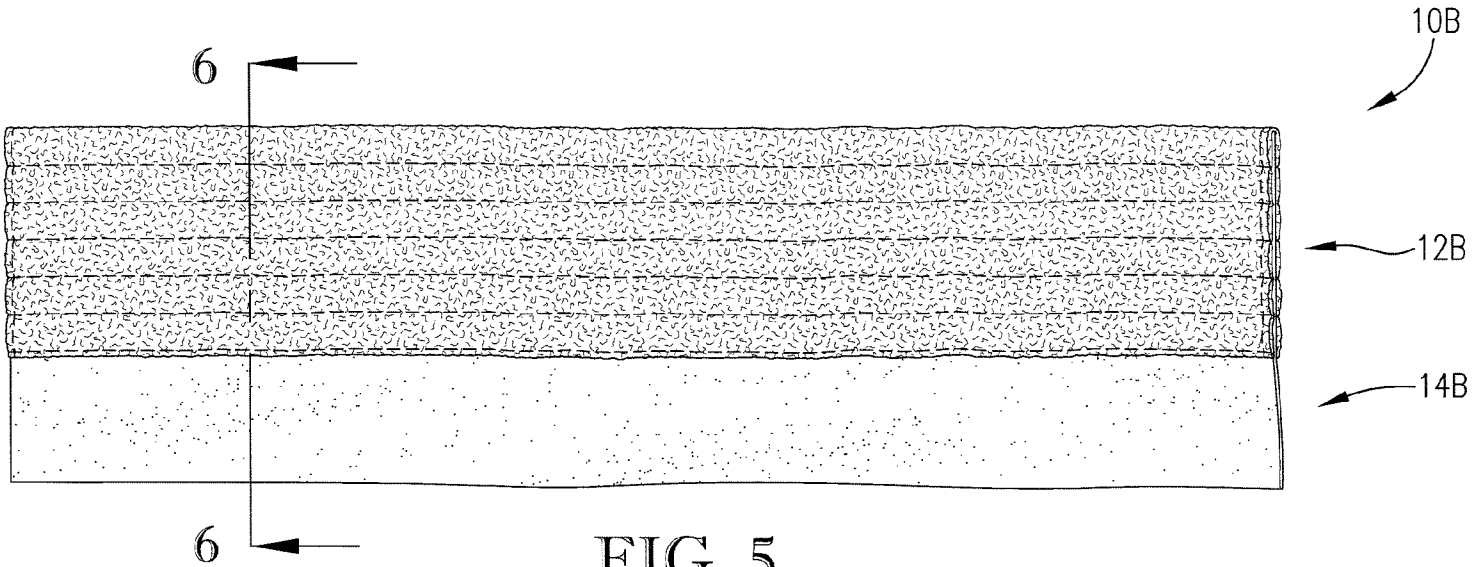
FIG. 5 is a top view of a cleaning towel constructed in accordance with another alternate embodiment of the invention.
Figure 6:
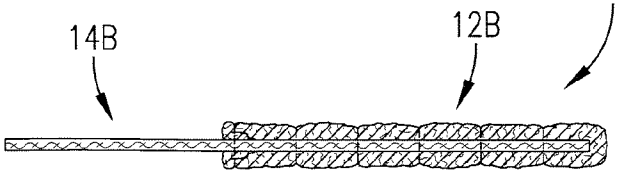
FIG. 6 is a side sectional view of the cleaning towel taken along line 6-6 of FIG. 5.

FIGS. 5 and 6 illustrate a towel 10B constructed in accordance with an alternate embodiment of the invention. The towel 10B is substantially identical to the towel 10 of FIGS. 1 and 2 except that its first portion 12B occupies an even larger percentage of the total surface of the towel. Specifically, the first portion 12B may occupy between 60-90% of the total surface area of the towel 10B. The towel 10B is particularly useful for cleaning extremely dirty vehicles. This embodiment of the towel may also be sized and shaped for attachment to a mop head such as a Swiffer® mop.

Figure 7:
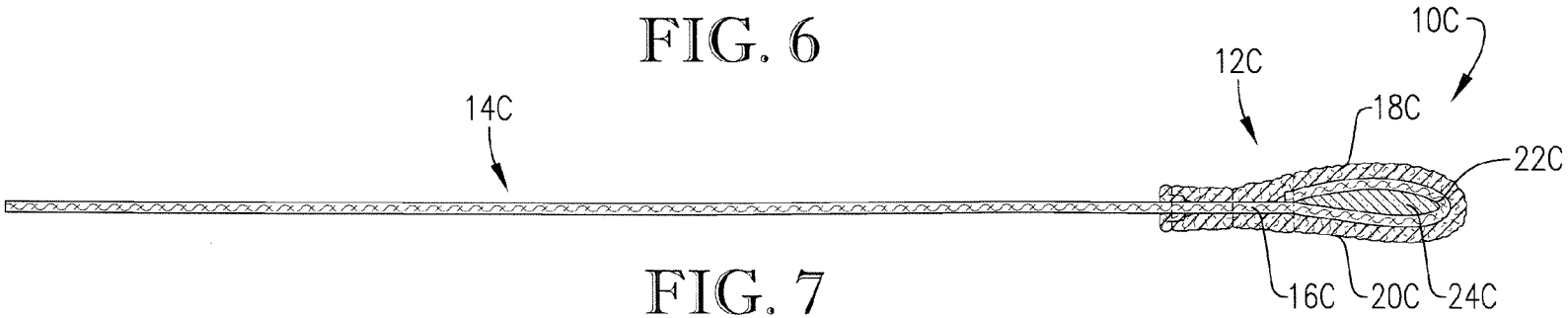
FIG. 7 is a side sectional view of a cleaning towel constructed in accordance with yet another embodiment of the invention.

FIG. 7 illustrates a towel 10C constructed in accordance with yet another embodiment of the invention. The towel 10C may be used in areas where soaps and other cleaning agents are not prohibited. The first portion 12C of the towel 10C includes an underlying layer 16C that is partially folded over itself to form an elongated pocket 22C that runs the entire width of the towel 10C. The underlying layer may be made of any material that is water permeable such as microfiber, cotton, or even chamois with holes in it. An elongated bar or perforated tube of soap, wax, or other cleaning agent 24C may be inserted into the pocket 22C so that it can seep through the layers 16C, 18C, 20C to assist with the cleaning of the vehicle. The outer layers 18C and 20C are preferably formed of microfiber material and occupy anywhere from 10-90% of the total surface area of the towel. The second portion 14C is preferably formed of chamois material and occupies anywhere from 10-90% of the total surface area of the towel.

Although the invention has been described with reference to the preferred embodiment illustrated in the attached drawing figures, it is noted that equivalents may be employed and substitutions made herein without departing from the scope of the invention as recited in the claims. For example, the towels described herein can be made in any size and shape without departing from the scope of the invention. Also, although the towels are particularly useful for cleaning and drying vehicles, they can be used to clean other objects and surfaces such as boats, bikes, floors, table tops, cabinets, appliances, etc.

Having thus described the preferred embodiment of the invention, what is claimed as new and desired to be protected by Letters Patent includes the following:

1. A towel for cleaning and drying a surface, the towel comprising:
- a first relatively thicker portion formed primarily of an underlying layer of material and an outer layer of microfiber material that is folded over and attached to both faces of the underlying layer of material; and
- a second relatively thinner portion formed primarily of chamois material.

2. The towel as set forth in claim 1, wherein the first portion occupies approximately 10%-40% of the a surface area of the towel.

3. The towel as set forth in claim 1, wherein the first portion occupies approximately 40%-60% of a total surface area of the towel.

4. The towel as set forth in claim 1, wherein the first portion occupies approximately 60%-90% of a total surface area of the towel.

5. The towel as set forth in claim 1, wherein the underlying layer of material in the first portion is formed primarily of chamois material.

6. The towel as set forth in claim 1, wherein the first portion is approximately 3/16" to 3/8" thick.

7. The towel as set forth in claim 1, wherein the second portion is approximately 1/16" to 1/8" thick.

8. The towel as set forth in claim 1, wherein the second portion and the underlying layer in the first portion are formed from a single piece of chamois material.

9. A towel for cleaning and drying a surface, the towel comprising:
- a chamois material;
- a first layer of microfiber material attached to one face of the chamois material; and
- a second layer of microfiber material attached to an opposite face of the chamois material,
- wherein the microfiber material covers approximately 10%-40% of a surface area of the chamois material.

10. The towel as set forth in claim 9, wherein the chamois material is approximately 1/16" to 1/8" thick.

11. The towel as set forth in claim 9, wherein the chamois material and the first and second layers of microfiber material are together 1/8" to 3/8" thick.

12. A towel for cleaning and drying a surface, the towel comprising:
- a chamois material;
- a first layer of microfiber material attached to one face of the chamois material; and
- a second layer of microfiber material attached to an opposite face of the chamois material,
- wherein the microfiber material covers approximately 40%-60% of a surface area of the chamois material.

13. A towel for cleaning and drying a surface, the towel comprising:
- a chamois material;
- a first layer of microfiber material attached to one face of the chamois material; and
- a second layer of microfiber material attached to an opposite face of the chamois material,
- wherein the microfiber material covers approximately 60% -90% of a total surface area of the chamois material.

14. A towel for cleaning and drying a surface of a vehicle, the towel comprising:
- a first portion formed primarily of an underlying layer of chamois material, a first layer of microfiber material attached to one face of the underlying layer of chamois material, and a second layer of microfiber material attached to an opposite face of the underlying layer of chamois material; and
- a second portion formed primarily of chamois material that is an extension of the underlying layer in the first portion, wherein the first portion is approximately three times as thick as the second portion.

15. The towel as set forth in claim 14, wherein the first portion occupies approximately 10%-40% of a total surface area of the towel.

16. The towel as set forth in claim 14, wherein the first portion occupies approximately 40%-60% of a total surface area of the towel.

17. The towel as set forth in claim 14, wherein the first portion occupies approximately 60%-90% of a total surface area of the towel.

18. The towel as set forth in claim 14, wherein the first portion is approximately 1/8" to 3/8" thick.

19. The towel as set forth in claim 14, wherein the second portion is approximately 1/16" to 1/8" thick.

* * * * *